US007245853B2

(12) United States Patent
Muramatsu et al.

(10) Patent No.: US 7,245,853 B2
(45) Date of Patent: Jul. 17, 2007

(54) DEVELOPER CONTAINER, DEVELOPER SUPPLYING UNIT, AND IMAGE FORMING APPARATUS

(75) Inventors: Satoshi Muramatsu, Tokyo (JP); Nobuo Iwata, Kanagawa (JP); Junichi Matsumoto, Kanagawa (JP); Nobutaka Takeuchi, Kanagawa (JP); Takayuki Koike, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 10/942,879

(22) Filed: Sep. 17, 2004

(65) Prior Publication Data

US 2005/0089347 A1 Apr. 28, 2005

(30) Foreign Application Priority Data

Sep. 18, 2003 (JP) ..... 2003-326384

(51) Int. Cl.
*G03G 15/08* (2006.01)

(52) U.S. Cl. ..... 399/120; 399/262; 383/67; 383/80; 383/88; 383/89; 383/125

(58) Field of Classification Search ..... 399/120, 399/262; 383/59, 125, 80
See application file for complete search history.

(56) References Cited

U.S. PATENT DOCUMENTS

| | | | |
|---|---|---|---|
| 4,106,611 | A | 8/1978 | Suzuki et al. |
| 4,126,400 | A | 11/1978 | Suzuki et al. |
| 4,160,200 | A | 7/1979 | Imamura et al. |
| 4,165,190 | A | 8/1979 | Suzuki et al. |
| 4,228,577 | A | 10/1980 | Suzuki et al. |
| 4,335,970 | A | 6/1982 | Iwata et al. |
| 4,411,539 | A | 10/1983 | Iwata et al. |
| 4,416,556 | A | 11/1983 | Iwata et al. |
| 4,436,440 | A | 3/1984 | Iwata |
| 4,572,682 | A | 2/1986 | Iwata |
| 4,747,710 | A | 5/1988 | Iwata et al. |
| 4,908,661 | A | 3/1990 | Iwata et al. |
| 4,983,055 | A | 1/1991 | Iwata |
| 5,008,711 | A | 4/1991 | Sakamoto et al. |
| 5,092,691 | A | 3/1992 | Iwata |
| 5,467,175 | A | 11/1995 | Takagaki et al. |
| 5,599,645 | A | 2/1997 | Tamiya et al. |
| 5,638,159 | A | 6/1997 | Kai et al. |
| 5,678,161 | A | 10/1997 | Kurotaka et al. |
| 5,797,074 | A | 8/1998 | Kasahara et al. |
| 5,799,228 | A | 8/1998 | Iwata et al. |
| 5,815,784 | A | 9/1998 | Kasahara et al. |
| 5,828,926 | A | 10/1998 | Iwata et al. |
| 5,875,380 | A | 2/1999 | Iwata et al. |
| 5,937,228 | A | 8/1999 | Shoji et al. |

(Continued)

FOREIGN PATENT DOCUMENTS

| | | |
|---|---|---|
| JP | 2001-324863 | 11/2001 |

(Continued)

*Primary Examiner*—David M. Gray
*Assistant Examiner*—Ryan D. Walsh
(74) *Attorney, Agent, or Firm*—Oblon, Spivak, McClelland, Maier & Neustadt, P.C.

(57) ABSTRACT

A developer container includes a developer storage unit made of a flexible sheet material for storing developer, and a cap unit from which the developer is discharged. The developer storage unit includes a holding member that holds a folded state when the developer storage unit is folded.

22 Claims, 8 Drawing Sheets

U.S. PATENT DOCUMENTS 5,953,567 A 9/1999 Muramatsu et al.
5,960,246 A 9/1999 Kasahara et al.
5,962,783 A 10/1999 Iwata et al.
5,963,240 A 10/1999 Shinohara et al.
5,987,298 A 11/1999 Muramatsu et al.
6,112,046 A 8/2000 Suzuki et al.
6,128,459 A 10/2000 Iwata et al.
6,142,690 A 11/2000 Yoshimura et al.
6,163,669 A 12/2000 Aoki et al.
6,184,910 B1 2/2001 Sasaki et al.
6,201,941 B1 3/2001 Kasahara et al.
6,282,396 B1 8/2001 Iwata et al.
6,295,437 B1 9/2001 Hodoshima et al.
6,366,751 B1 4/2002 Shakuto et al.
6,381,435 B2 4/2002 Shinohara et al.
6,393,241 B1 5/2002 Matsumoto et al.
6,442,364 B2 8/2002 Kai et al.
6,507,720 B2 1/2003 Kabumoto et al.
6,526,246 B2 2/2003 Iwata et al.
6,542,707 B2 4/2003 Muramatsu et al.
6,567,637 B2 5/2003 Yanagisawa et al.
6,571,076 B2 5/2003 Kasahara et al.
6,597,883 B2 7/2003 Muramatsu et al.
6,597,885 B2 7/2003 Kai et al.
6,604,674 B1 * 8/2003 Bowman ..... 229/116.5
6,608,983 B2 8/2003 Terazawa et al.
6,608,984 B1 8/2003 Matsumoto et al.
6,625,409 B2 9/2003 Shakuto et al.
6,628,908 B2 9/2003 Matsumoto et al.
6,628,913 B2 9/2003 Matsumoto et al.
6,628,915 B2 9/2003 Muramatsu et al.
6,654,579 B2 11/2003 Shakuto et al.
6,665,511 B2 12/2003 Takeuchi et al.
6,674,982 B2 1/2004 Saitoh et al.
6,678,492 B1 1/2004 Terazawa et al.
2001/0043256 A1 * 11/2001 Seccombe et al. ..... 347/85
2003/0012586 A1 * 1/2003 Iwata et al. ..... 399/258
2004/0008908 A1 * 1/2004 Shepard ..... 383/89
2004/0009017 A1 * 1/2004 Yoshino et al. ..... 399/262
2004/0120724 A1 * 6/2004 Takiguchi ..... 399/111
2004/0145763 A1 * 7/2004 Dougherty et al. ..... 358/1.13

FOREIGN PATENT DOCUMENTS

JP 2002-046843 2/2002
JP 2002-072649 3/2002
JP 2002-268346 9/2002

* cited by examiner

DEVELOPER CONTAINER, DEVELOPER SUPPLYING UNIT, AND IMAGE FORMING APPARATUS

CROSS-REFERENCE TO RELATED APPLICATIONS

The present document incorporates by reference the entire contents of Japanese priority document, 2003-326384 filed in Japan on Sep. 18, 2003.

BACKGROUND OF THE INVENTION

1) Field of the Invention

The present invention relates to a developer container for a developer supplying unit and an electrophotographic image forming apparatus.

2) Description of the Related Art

Electrophotographic apparatuses generally use powder developer called toner or carrier so as to form toner images using developing devices and create images. Since toner is consumed as images are formed, the toner which is stored in toner cartridges (developer containers) is fed to main units, and the toner cartridge which runs short of the toner is generally replaced by a new one so that new toner is supplied.

Toner supplying units (developer supplying units) require a function such that toner in toner containers is discharged securely and completely and the discharged toner is delivered to developing devices securely. Conventional toner containers require the function of discharging toner securely and completely from the toner containers.

As the toner supplying units, as shown in FIG. 8A, a device, which has a movable member 12 such as a screw or a coil spring commonly known as an auger in a toner storage container 11, is known. In the toner supplying unit, when a rotary shaft 13 of the movable member 12 is driven to be rotated, the toner in the toner storage container 11 is transported to a direction towards a discharge port 11*a* and is discharged form the discharge port 11*a* to be supplied to a developer supplying unit.

On the other hand, as shown in FIG. 8B, a device called a screw bottle 15, which uses a cylindrical toner stage container formed with spiral projections 14 on its inner periphery along a peripheral direction, is known. In this toner supplying unit, the screw bottle 15 is driven to be rotated, so that toner in the screw bottle is transported to a direction of a discharge port 15*a*, and is discharged from the discharge port 15*a* so as to be supplied to a developer supplying unit.

A system which does not have a discharge mechanism in a toner container is developed recently. A system, in which toner in a bag type soft container is pumped by a suction pump and is fed to a developing device, is already manufactured. Further, the inner toner is pumped and discharged so that a volume of the container from which the toner is discharged can be reduced (the container deflates) (see, for example, Japanese Patent Application Laid-Open No. 2001-324863 and Japanese Patent Application Laid-Open No. 2002-72649). A toner transport method of accelerating a toner storage container due to asymmetrical reciprocating motion, and moving the toner in the container to one direction by inertia so as to discharge the toner from a discharge port provided at a lower portion of the container is proposed (see, for example, Japanese Patent Application Laid-Open No. 2002-046843 and Japanese Patent Application Laid-Open No. 2002-268346).

Since toner cartridges are, however, consumable goods and used containers are generated every time of toner replacement, obviously, resource saving of toner containers is desired from a viewpoint of not only the costs but also environmental protection. Further, it is an important task for the environmental protection that manufacturers retrieve toner containers and reuse or recycle them.

In the delivery system using an auger, a member should be provided in a container and be rotated, which constitution is complicated, thereby inhibiting the resource saving and increasing the cost. In the delivery system using the screw bottle, a member is not provided in a container, and thus its constitution is simple. Since a screw groove is, however, provided to a wall of the container and the container is rotated to be used, the shape of the container is limited to a cylindrical hard bottle, thereby limiting resource saving.

Since the toner delivery system using the suction pump adopts the system in which a suction pump pumps toner in the toner container, the toner container does not require the toner discharge function, and thus a toner container which remarkably saves resources can be used. An example of such a container is a bag type flexible container made of a thin sheet.

Since an oscillating system does not require a delivery member in a container, a flexible container which saves resources can be used similarly to the system adopting the suction pump. This system has an advantage such that it can adopt a simple container shape with a large intake capacity (small dead space) such as cuboid. Since the volume of the flexible containers can be reduced, they have excellent transport efficiency at the time of retrieving used containers.

The manufacturers' work for retrieving toner containers is actually inefficient in some occasions. The occasions include ones where manufacturers' branch offices and service depositors are separated from users, and the occasion where some numbers of cartridges are retrieved. In these occasions, a retrieving system in which users send back used toner containers to the manufacturers by mail is effective. The flexible containers have an advantage such that they can be sent by ordinary mail.

However, some small amount of toner adheres to used toner containers and when the toner containers in this state are sent by mail, other postal matters could be stained by the toner, and thus the toner containers should be enclosed in bags or envelopes. Also when used toner containers are stored, they must be kept in bags or the like similarly because depositories could be stained by the toner. This work takes an effort and increases the cost, and also hands are stained by the toner during the work, or the toner scatters in the bags. Therefore, when the toner containers are taken out of the bags and are treated after retrieval, the work may become inefficient

SUMMARY OF THE INVENTION

It is an object of the present invention to solve at least the above problems in the conventional technology.

A developer container according to one aspect of the present invention includes a developer storage unit made of a flexible sheet material for storing developer, and a cap unit from which the developer is discharged. The developer storage unit includes a holding member that holds a folded state when the developer storage unit is folded.

A developer supplying unit according to another aspect of the present invention includes a developer container that includes a developer storage unit made of a flexible sheet material for storing developer that includes a holding member that holds a folded state when the developer storage unit is folded, and a cap unit from which the developer is discharged; and a pumping unit that pumps the developer to supply the developer to a developing unit. A volume of the developer container is reduced with pumping of the developer.

An image forming apparatus according to still another aspect of the present invention includes a developer supplying unit that includes a developer container including a developer storage unit made of a flexible sheet material for storing developer that includes a holding member that holds a folded state when the developer storage unit is folded, and a cap unit from which the developer is discharged; and a pumping unit that pumps the developer to supply the developer to a developing unit. A volume of the developer container is reduced with pumping of the developer.

The other objects, features, and advantages of the present invention are specifically set forth in or will become apparent from the following detailed description of the invention when read in conjunction with the accompanying drawings.

DETAILED DESCRIPTION

Figure 1:
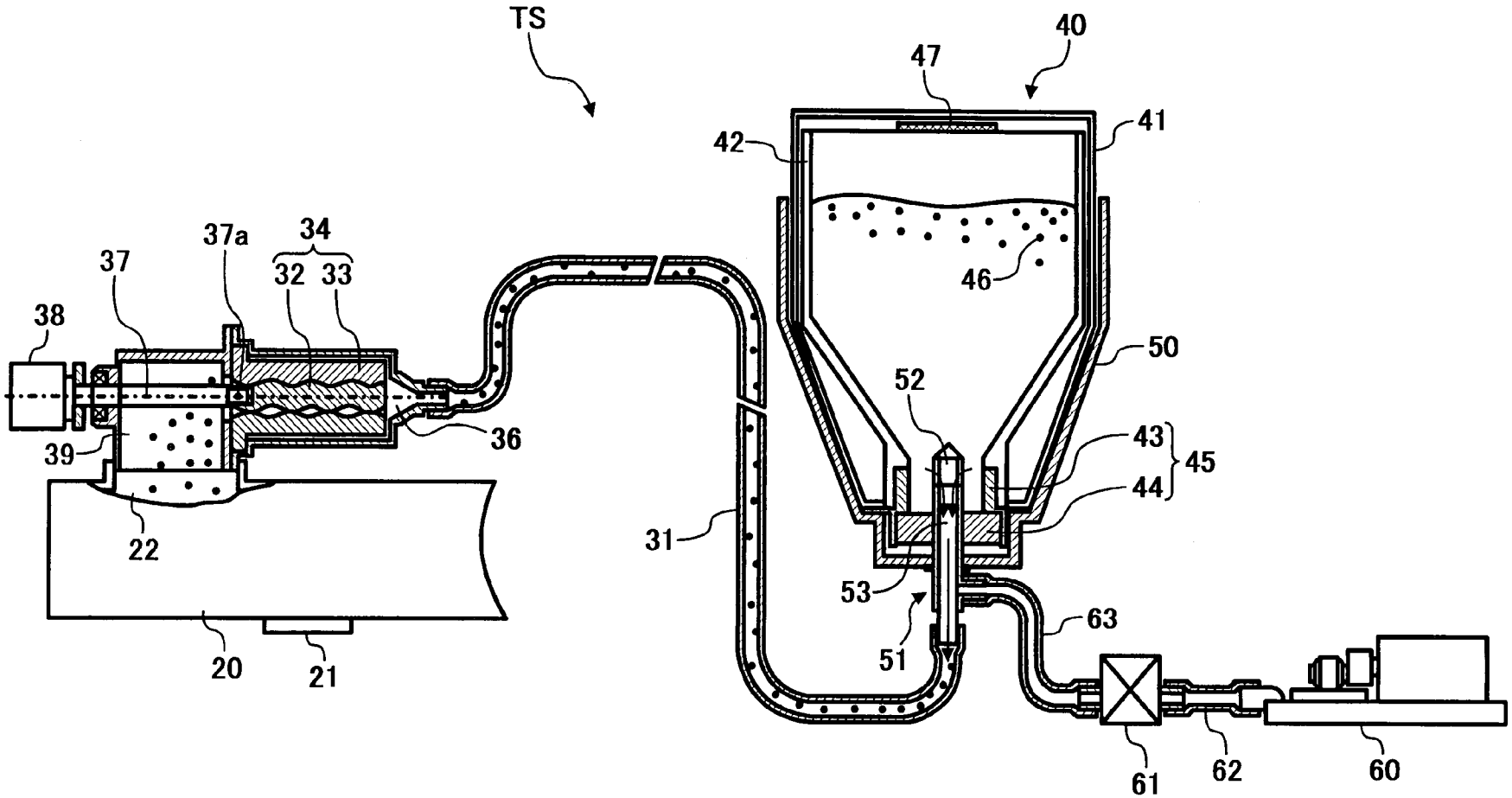
FIG. 1 is a schematic of a toner supplying unit as one example of a developer supplying unit of the present invention.

Exemplary embodiments of a developer container, developer supplying unit, and an image forming apparatus according to the present invention are explained in detail with reference to the accompanying drawings. FIG. 1 is a schematic of a toner supplying unit as one example of a developer supplying unit of the present invention. The developer supplying unit is provided to an image forming apparatus.

A powder pump (pumping unit) 34 is a suction type pump having a rotor 32 and a stator 33, and when the rotor 32 is actuated, a suction force is generated at a suction port 36. A toner channel which connects a toner container (developer storage unit) 42 in a toner cartridge (developer supplying container) 40, a nozzle 51, a transport tube 31, and the powder pump 34 is sealed. For this reason, the suction force which is generated by actuating the powder pump 34 is transmitted to toner (developer) 46 near the nozzle in the toner container 42 via the transport tube 31 and the nozzle 51, 50 that the toner 46 can be transported. An air pump 60 supplies air into the toner in the toner container 42 via a tube 63, an electromagnetic valve 61, and the nozzle 51. The toner 46 may be carrier or a mixture of carrier and toner.

After the powder pump 34 pumps the toner 46 near the nozzle 51, a cross-link phenomenon (a portion of the toner container 42 where no toner is present is hollowed so that a cavity is generated) occurs in the toner cartridge 40. As a result, a toner supply amount becomes unstable or a toner residue in the toner container becomes remarkably large in some occasions. Air is, however, supplied from the air pump 60 into the toner container 42, so that the toner 46 is agitated and fluidized, thereby preventing the cross-link phenomenon of the toner 46. The cross-linkage of the toner 46 is resolved by the supplied air, so that the toner supply amount is stabilized and the toner residue in the toner container 42 is reduced.

At this time, an air-permeable filter (air-permeable unit) 47 may be provided at an upper portion of the toner container 42, thereby preventing the air supplied from the air pump 60 from raising inner pressure of the toner container 42. The electromagnetic valve 61 is provided in a halfway portion of the tube 63 connecting the air pump 60 and the nozzle 51, and it is opened only at the time of actuating the air pump 60 and is closed normally. This is to prevent the toner transport amount from lowering due to suction of the air from the air pump 60 when the powder pump 34 is actuated, The toner 46 pumped from the toner container 42 by the powder pump 34 is supplied into a developing device 20 via a toner passage 39. A reference numeral 21 designates a toner density sensor in the developing device, and a toner supply signal is generated by an output from the sensor as required, so that the powder pump 34 is driven for necessary time according to the output from the sensor.

A reference numeral 50 designates a container holder that holds a protective case 41 of the toner cartridge 40. The protective case 41 is made of a material such as paper having rigidity, corrugated board, or plastic, and the bag type toner container 42 is wrapped with the protective case 41. One portion of the protective case 41 is engaged with a cap unit 45. The toner container 42 is formed into a sealed bag type container shape in such a manner that a single flexible sheet material (thickness is about 50 to 250 micrometers) or a plurality of laminated sheet materials, made of resin such as polyethylene or nylon or paper, is (are) folded, or four sheets are welded or adhered. With such a shape, air does not flow into or out of the toner container 42.

The cap unit 45 having a function as a toner discharge port of the bag type container made of the sheet material is provided at a lower end of the toner container 42 by thermal welding, adhesion, or the like. The cap unit 45 has a case 43 made of resin, paper, or the like, and a seal 44 such as sponge. The nozzle 51 has a toner discharge hole 52 at its end and a toner discharge path 53 at its axial center. In a state that the toner cartridge 40 is set in the container holder 50, the nozzle 51 is inserted into the seal 44 of the cap unit 45, and thus a seal 44 is firmly stuck to the nozzle 51, thereby preventing the toner from leaking from the toner container 42 to the outside.

If the toner container 42 and the cap unit 45 are made of the same material, when the used container is recycled, it is not necessary to sort out the container 42 and the cap unit 45 according to materials, thereby improving recycling efficiency.

As a method of setting a new toner container 42 after the toner 46 in the toner container 42 is completely consumed, the toner cartridge 40 is taken out, the used toner container 42 is removed from the protective case 41, and the new toner container 42 is set in the protective case 41.

The delivery member 31 has a tube shape with inner diameter ϕ of 3 to 7 millimeters, and is made of a flexible rubber material with excellent toner resistance such as polyurethane, nitrile, ethylene propylene diene monomer (EPDM), and silicon, or a plastic material such as polyethylene and nylon. As a result, the toner transport channel can be arranged freely, and a degree of layout freedom in the image forming apparatus is increased, namely, these materials are effective. The toner supplying unit TS is fixed to a frame of the image forming apparatus.

Since the toner supplying unit TS delivers the toner 46 by pressure of the powder pump 34, even when the position of the toner container 42 is lower than the developing device 20, the toner 46 can be delivered. That is, since the toner container 42 can be arranged freely, it can be arranged in a position where the toner replacement is carried out the most easily.

The powder pump 34 has a female screw type stator 33 having a spiral groove with a double pitch made of an elastic member such as rubber, and a male screw type rotor 32 which is fitted into the stator 33 rotatably and is made of metal, resin, or the like. The rotor 32 is connected with a driving shaft 37 by a spring pin 37*a* or the like. The rotating shaft 37 is rotated by rotating a driving motor 38, and its movement is transmitted to the rotor 32 so that the rotor 32 is eccentrically moved. For this reason, the powder pump 34 is called also as a single-shaft eccentric screw pump. The rotation of the rotor 32 generates suction pressure at the suction port 36, and the toner 46 pumped from the suction port 36 is dropped down into the toner passage 39.

The manufactures take back the used toner containers 42 from users, and the used containers 42 are sometimes reused or recycled. At this time, the volume of flexible containers can be reduced and they can be further folded. The handleability of such containers is excellent at the time of transportation and storage, the storage space can be reduced, and physical distribution cost can be reduced.

Figure 2A:
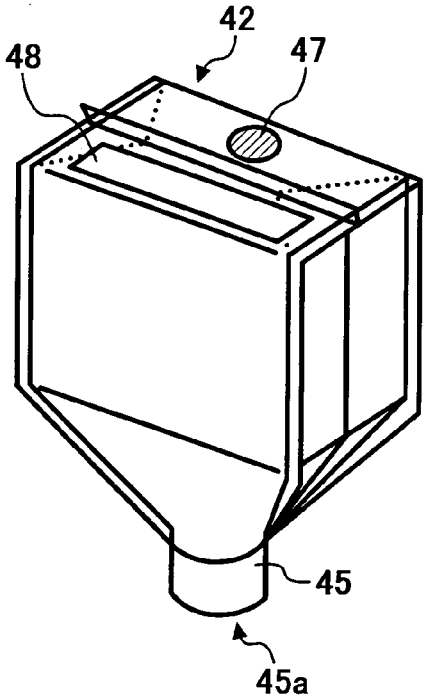
FIGS. 2A to 2D are schematics for illustrating a method of folding a toner container used in the toner supplying unit shown in FIG. 1.
Figure 2B:
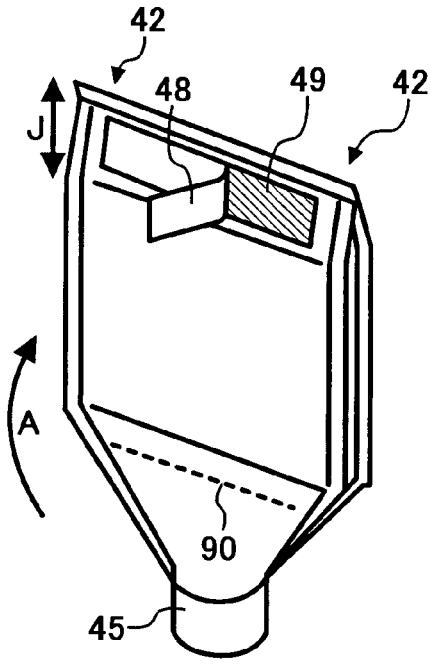
Figure 2C:
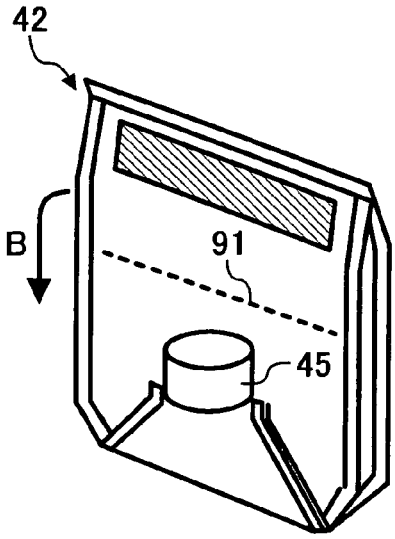

FIGS. 2A to 2D are schematics for illustrating a method of folding the toner container 42 used in the toner supplying unit shown in FIG. 1. FIG. 2A depicts a state that the used toner container 42 is taken out of the container holder 50. The toner container 42 is crushed so that only air is drained form the air filter (air-permeable unit) 47, and the toner container 42 is crushed as shown in FIG. 2B. When the toner container 42 is crushed, the height of the container is increased by J, and thus it is necessary that the protective case 41 has a space for J.

Figure 2D:
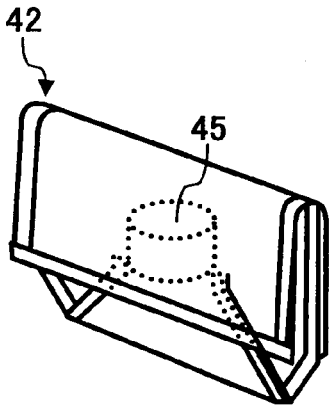

When sticker sheet 48 made of a two-sided tape or the like is peeled, an adhesive tape (holding member) 49 under the sticker sheet 48 appears. When the toner container 42 is folded along a first folding line (folding indication portion) 90 for folding the toner container on the surface of the toner container 42 as shown by an arrow A with the cap unit 45 facing upwards, the toner container is in a state shown in FIG. 2C. When the toner container 42 is further folded along a second folding line (folding indication portion) 91 as shown by an arrow B with its upper portion facing downward, the adhesive tape 49 holds the toner container 42 in a state that it is folded with the cap unit 45 facing inward as shown in FIG. 2D. It is more preferable that the adhesive tape 49 is colored so as to be a holding indication portion.

The cap unit 45 of the used toner container 42 is somewhat stained by the toner 46 normally due to attachment/detachment work of the toner container 42. When the toner container 42 is, however, crushed so that its volume is reduced, and it is folded, the stained cap unit 45 is covered with the toner container 42, thereby preventing the cap unit 45 from exposing to the outside. Further, when the folded toner container 42 is stored, circumference is not stained by the toner container 42, and the toner container 42 can be sent as it is by ordinary mail.

Figure 3A:
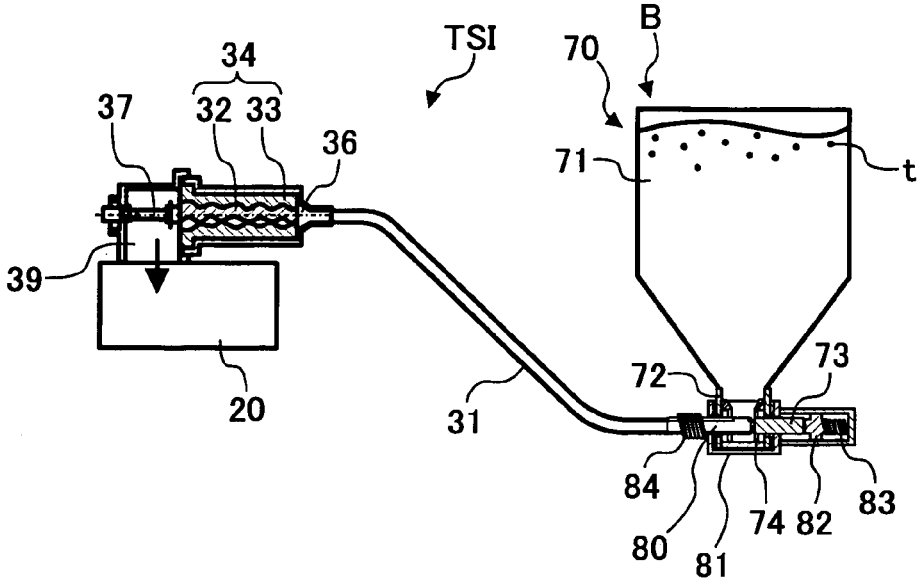
FIG. 3A is a schematic of a toner supplying unit as another example of the developer supplying unit of the present invention.

FIG. 3A is a schematic of a toner supplying unit (developer supplying unit) TS1 which supplies toner (developer) t to the developing device 20 from a toner container (developer storage unit) 71 of a developer container B. The toner supplying unit TS1 is constituted so that a protective case 70 is provided and the toner t in the protective case 70 is pumped and discharged by the powder pump 34 as a single-shaft screw pump having the same constitution as that in FIG. 1 so as to be supplied into the developing device 20.

The difference from the toner supplying unit TS in FIG. 1 is in that air is not supplied to the toner container 71, and since an air filter is not provided to the toner container 71, a portion from the toner container 71 via the transport channel 31 of the toner t to the powder pump 34 is substantially completely sealed. For this reason, the powder pump 34 pumps and discharges the toner t, and the toner container 71 is crushed and reduced in volume by a volume of the discharged toner t. This is an automatic volume reducing system. In this example, the developer container means the toner container 71 and a cap unit 72.

The protective case 70 includes the bag type flexible toner container 71 which stores the toner t and the cap unit 72 connected to its lower portion. A suction nozzle 80 is inserted into the cap unit 72. Reference numeral 73 designates a shutter that prevents the outflow of the toner, and when the nozzle 80 is not inserted into the cap unit 72, it closes the cap unit 72. Reference numeral 74 designates a nozzle or a seal member which is arranged on both sides of the shutter and maintains airtightness. The nozzles 74 are connected to the powder pump 34 via the tube 31.

A portion from the nozzles 74 to the developing device 20 is fixed to the image forming apparatus similarly to the example of FIG. 1. Every time when the toner t is consumed completely, the toner container 71 is replaced by a new toner container. Since the nozzles 74 are attached and detached every time of replacement, the airtightness between the cap unit 72 and the nozzles 74 is very important in order to prevent stain and leakage of air at the time of attachment and detachment.

Figure 3B:
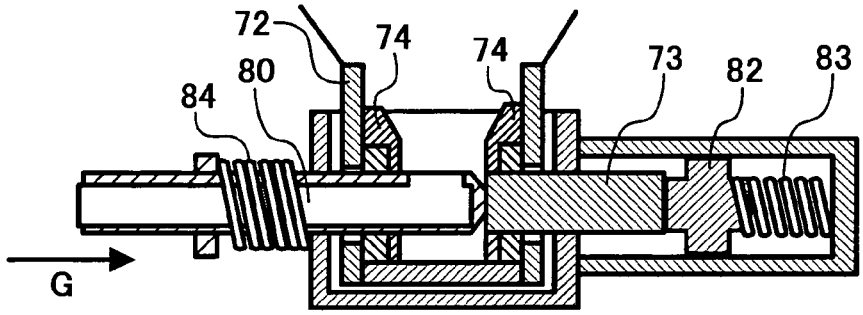
FIGS. 3B and 3C are enlarged sectional views near a cap member of the toner supplying unit.
Figure 3C:
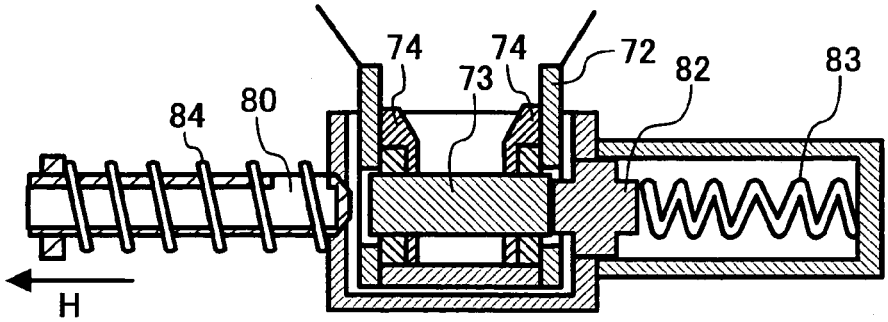

The opening/closing system of the shutter 73 is shown in FIGS. 3B and 3C. After the toner container 71 is set in the toner supplying unit TS1 as shown in FIG. 3B, the nozzle 80 moves to a direction of an arrow G against the spring 84. The shutter 73 is pushed out (the direction of the arrow G) from the inside of the cap unit by the nozzle 80. When the toner container 71 is taken out of the toner supplying unit TS1, the nozzle 80 moves to a direction of an arrow H as shown in FIG. 3C, and the shutter 73 is biased to the direction of the arrow H by the spring 83 and a shutter push-back member 82. The shutter 73 is approximately housed in the cap unit 72 as shown in the drawing (in the position same as that for the unused toner container), and the close-contact of the shutter 73 and the two seal materials 74 provided in the cap unit 72 can prevent a small amount of the residual toner t in the toner container 71 from leaking.

A moving unit that moves the shutter 73 to the directions of the arrows G and H is not shown, but a publicly-known conventional moving unit such as a lever (manual), a motor, or a solenoid may be used. The seals 74 are formed by a rubber material or the like which lightly pressure-contacts with the shutter 73. The cap unit 72 has a toner discharge port made of a hard member such as resin, and it is adhered or bonded so as to be fixed to the toner container 71.

In the above shutter opening/closing system, the flow channel of the toner t is not disturbed, and it is not necessary to provide a rest space where the shutter 73 rests to the outside of the cap unit 72, thereby making the cap unit 72 very compact. Since the shutter 73 is arranged so as to intersect perpendicularly to the flow channel of the toner t (pressure), the shutter 73 is not pushed out by the pressure of the container so as to be stable. This system has such advantages.

The toner container 71 is made of the similar material to that of the sheet constituting the toner container 42 shown in FIG. 1. A two-layered sheet of about 50 to 250 micrometers whose inside is made of polyethylene for welding and outside is made of nylon is used here. Aluminum or polyethylene terephthalate (PET) can be provided to the outside of the sheet in order to improve its strength or moisture resistance.

Figure 4A:
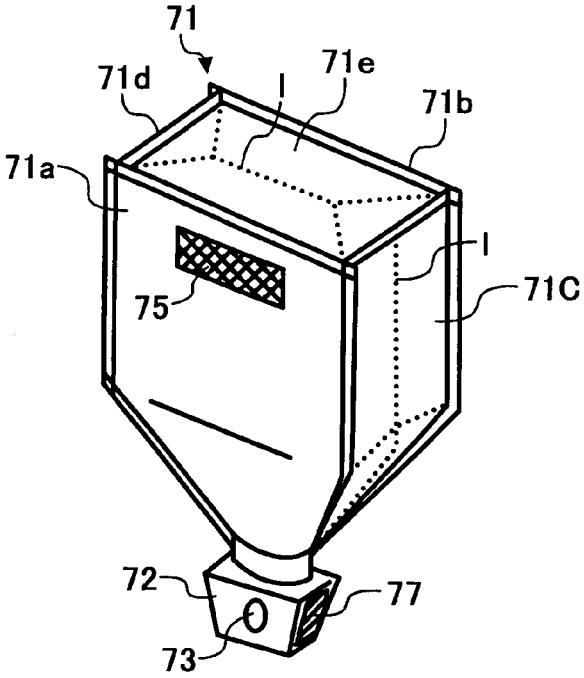
FIGS. 4A to 4D are schematics for illustrating a method of folding the toner container to be used in the toner supplying unit shown in FIGS. 3A to 3C.
Figure 4B:
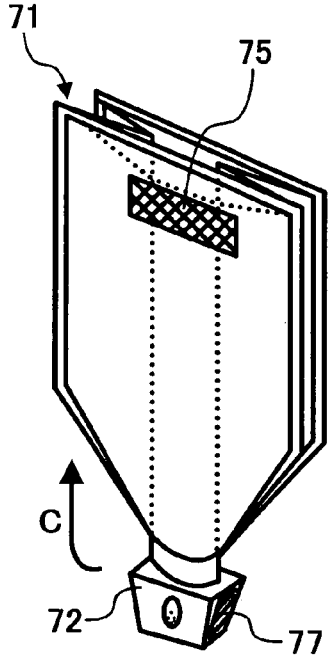

The toner container 71 is formed so as to have five surfaces 71*a* to 71*e* according to the automatic volume reducing system by thermally welding (or bonding) two to five sheets as shown in FIG. 4A. When the volume of the toner container 71 is reduced, it is folded inward while being contracted along dotted lines 1 on the respective surfaces as shown in FIG. 4B. For this reason, the height of the toner container 71 hardly increases, and thus this container is excellent in that an excessive space is not required in an up-down direction in the protective case 70 as shown in FIG. 2B.

Figure 4C:
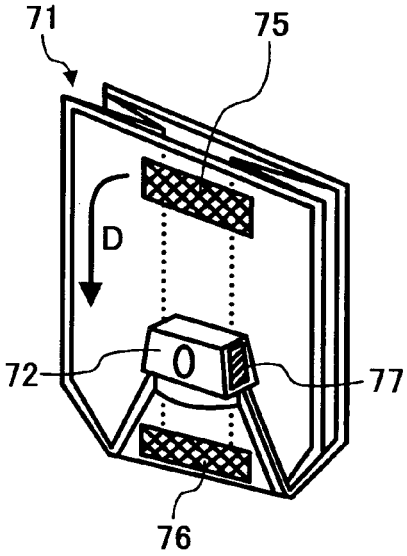
Figure 4D:
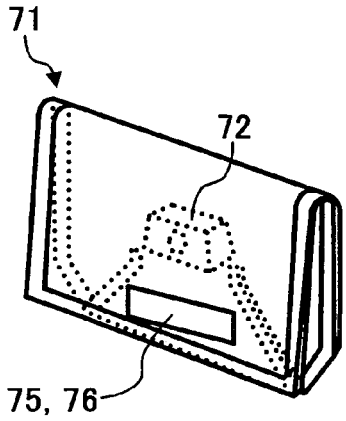

FIG. 4A is a schematic of the toner container 71 which is filled with unused toner t. At this time, an ID chip (memory element) 77 for product management is detachably attached to the side portion of the cap unit 72. FIGS. 4B to 4D are schematics of a folding method of the used toner container 71 taken out of the toner supplying unit TS1 of this example and a holding method of the folded toner container 71. The used toner container 71 which is taken out after the toner t is consumed is shown in FIG. 4B. After all the toner t is discharged from the toner container 71, the volume of the used toner container 71 is reduced substantially completely, and the used container 71 is crushed as shown in FIG. 4B.

Since a user does not need to crush the toner container as in the example in FIG. 2A, the folding work becomes easy. The folding work is similar to that of the former example, but a holding member that holds the folded state is different from that in the former example. That is, adhesive is used as the holding member in the former example, but in this example, mechanical fasteners (hook and loop fasteners) 75 and 76 are provided to the surfaces 71*a* and 71*b* of the toner container, respectively. The cap unit 72 is folded to a direction of an arrow C in FIG. 4B, and the toner container 71 is folded to a direction of an arrow D in FIG. 4C. The hook and loop fasteners 75 and 76 are laminated with each other so as to be fixed as shown in FIG. 4D. Here, it is more preferable that the mechanical fastener 75 is used as a male member, and the mechanical fastener 76 is used as a female member and as a holding indication portion.

Figure 5A:
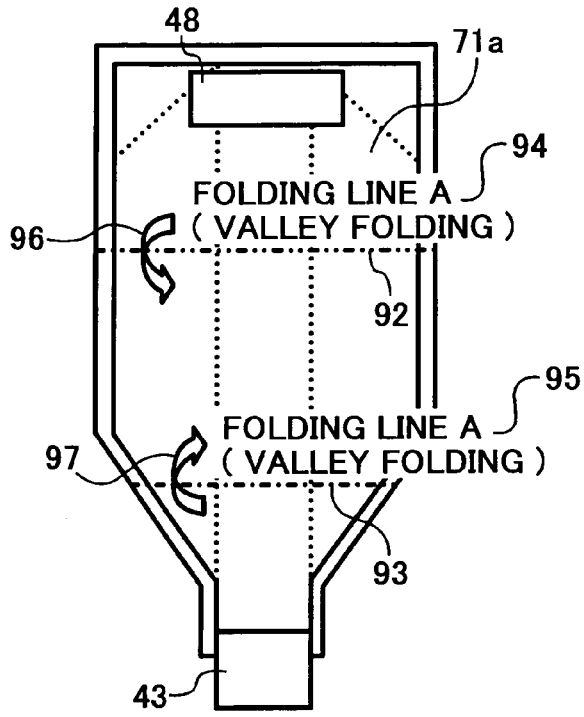
FIGS. 5A and 5B are schematics of other examples of the toner container shown in FIGS. 4A to 4D.

FIG. 5A is a schematic of an example in which characters and graphics for preventing faulty folding works and easy understandings of the works, and a service marking (holding indication portion) 48 indicating a laminating position of the adhesive tapes are displayed on the surface 71*a* of the toner container 71. The characters and graphics include folding lines (folding indication portions) 92 and 93, service markings 94 and 95 such as "folding line A (valley folding)", and arrows 96 and 97 indicating folding directions.

Figure 5B:
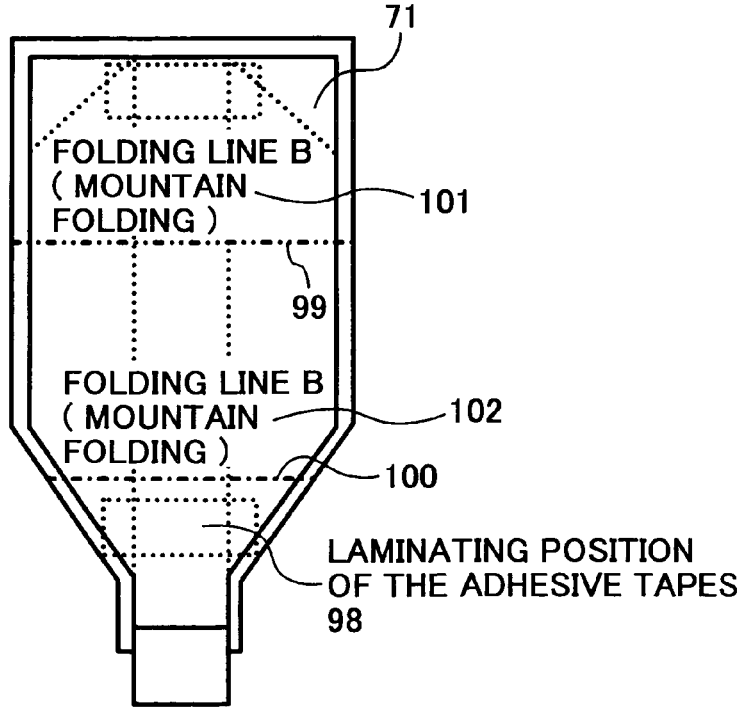

FIG. 5B is a schematic of another example of FIG. 5A that folding lines (folding indication portions) 99 and 100, service markings 101 and 102 such as "folding line B (mountain folding)", and a service marking (holding indication portion) 98 indicating the laminating position of the adhesive tapes are displayed on the surface 71*b* of the toner container 71.

These characters and graphics enable the holding member to be fixed accurately.

Figure 6:
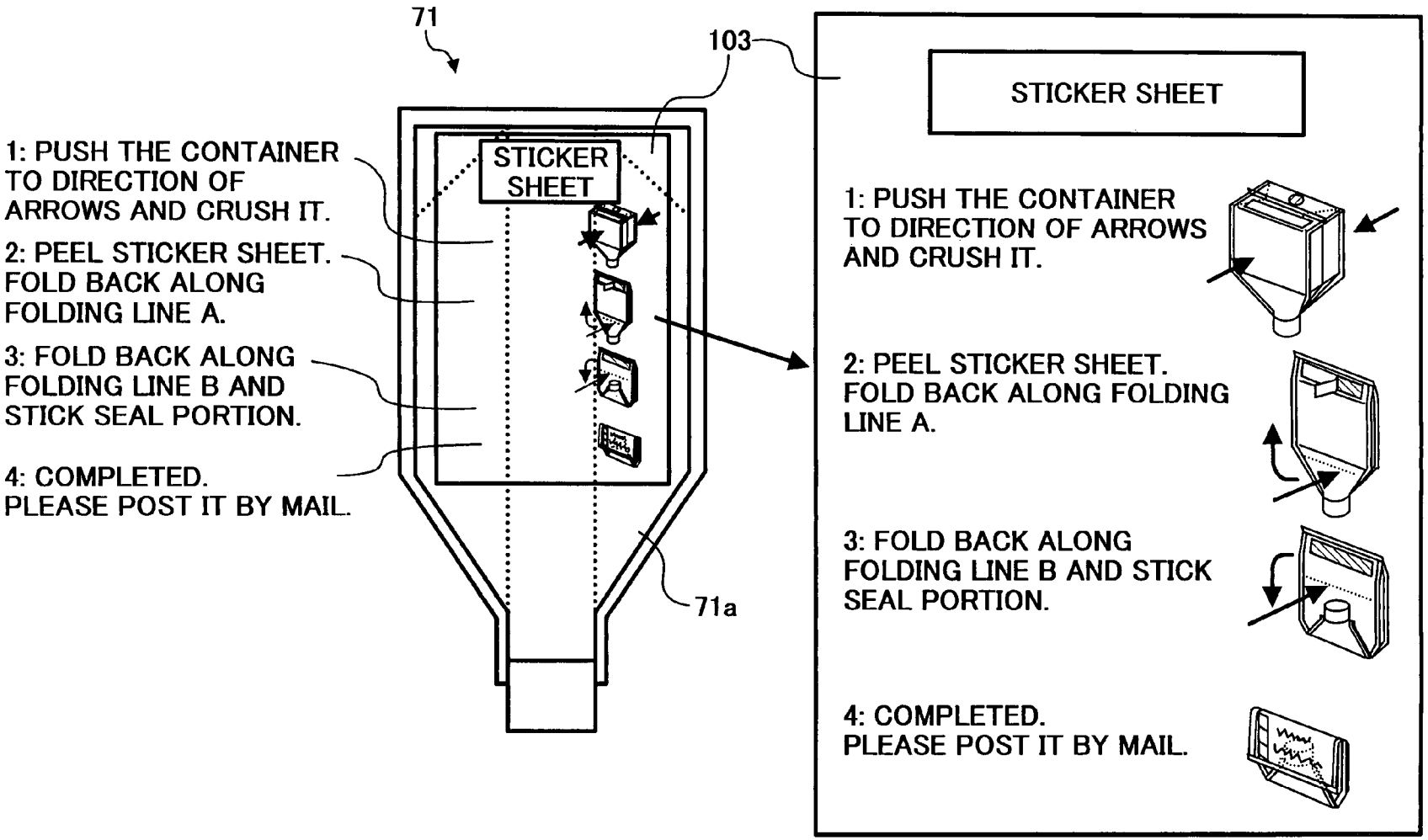
FIG. 6 is a schematic of still another example of the toner container shown in FIGS. 4A to 4D.

FIG. 6 is a schematic of still another example in which a display portion 103 showing a series of the work procedure from volume reduction to folding is printed on the toner container, or a sticker on which the work procedure is printed is put on the toner container. That is, this is an example in which the folding method and the holding method are described on the surface 71*a* of the toner container 71 using characters or graphics. As a result, the folding work can be executed more easily.

Figure 7A:
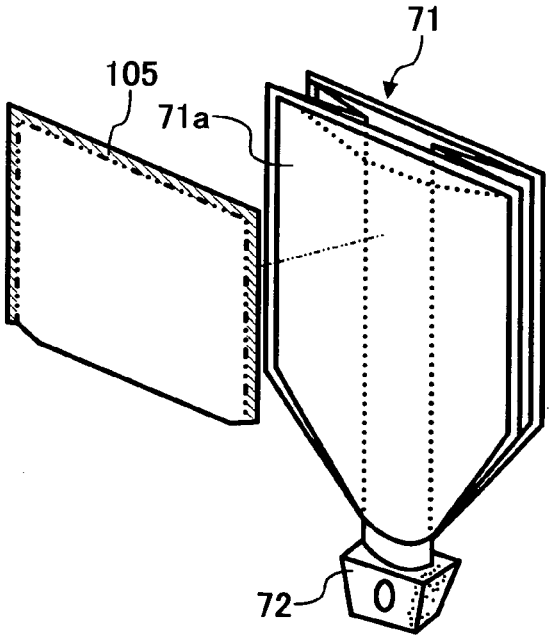
FIGS. 7A to 7C are schematics of still another example of the toner container shown in FIGS. 4A to 4D.

FIG. 7A is a schematic of still another example of the toner container 71 as a pocket portion 106 whose holding member is made of a sheet material. As shown in FIG. 7A, the pocket portion 106 is formed into a bag shape by thermally heating an overlap width 105 of the sheet. The pocket portion 106 is stuck to the surface 71*a* of the toner container 71 by thermal welding or bonding. That is, the pocket portion 106 is formed into a pocket shape onto the surface 71*a* of the toner container 71 by the sheet material.

In the above example, the toner is used as the developer, but the present invention is not limited to this, and another type of developer may be used.

Figure 7B:
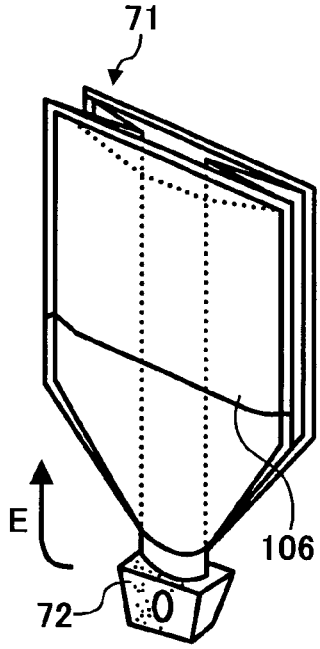
Figure 7C:
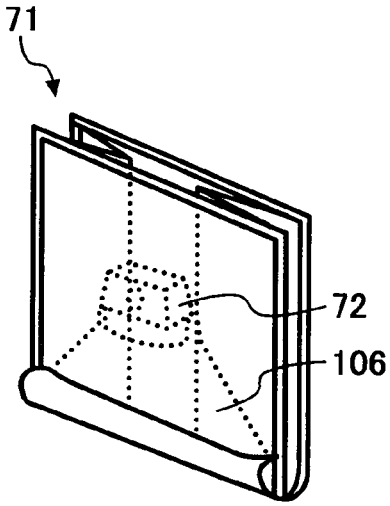
Figure 8A:
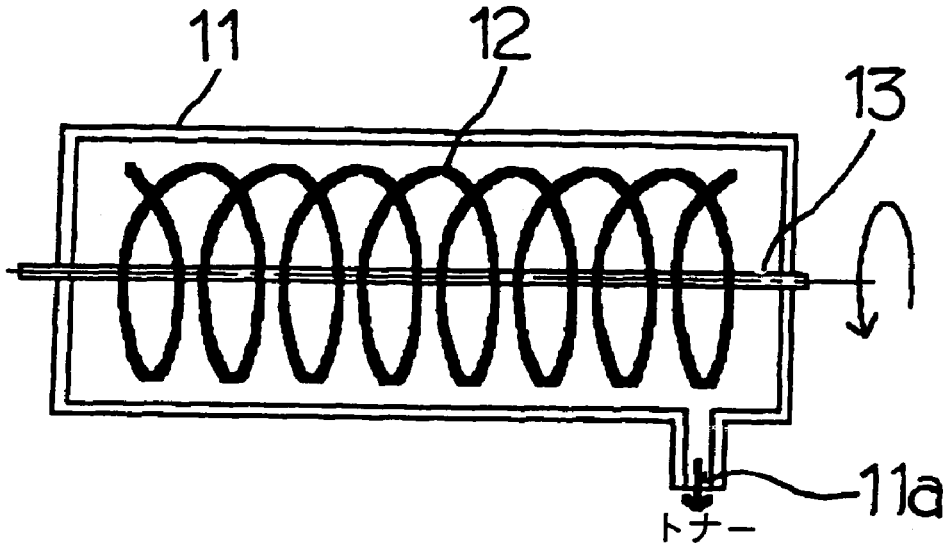
FIG.8A PRIOR ART
FIG. 8A is a schematic of a conventional toner bottle adopting an auger system.
Figure 8B:
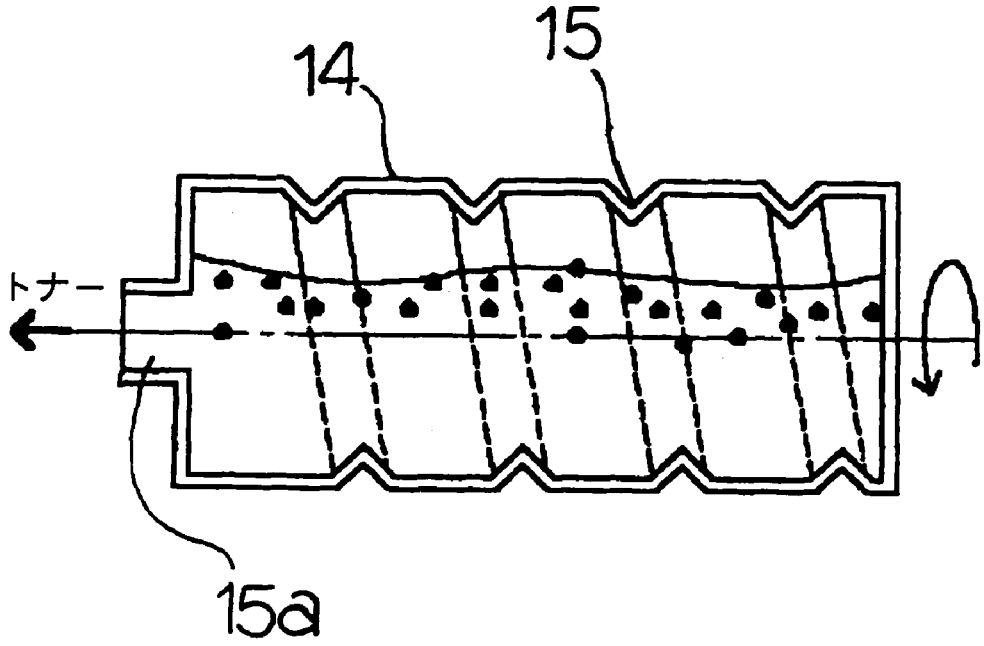
FIG.8B PRIOR ART
FIG. 8B is a schematic of a conventional toner bottle as a screw bottle.

The work for forming the pocket portion 106 and the work for sticking the pocket portion 106 to the surface 71*a* may be executed simultaneously or separately. In FIG. 7B, when the cap unit 72 is folded to a direction of an arrow E and is inserted into the pocket portion 106, the toner container 71 is in the state shown in FIG. 6C. The toner container 71 can be maintained in the double folded state easily by the pocket portion 106.

The folded toner container 71 can be sent by ordinary mail, and when it is put into an envelope or a bag to be sent or transported, its size becomes compact by folding it. For this reason, obviously, this constitution is advantageous in that the envelope or the bag can be compact. This constitution is particularly effective when a large toner container is used.

According to the first aspect of the invention, since the holding member that holds the folded state of the developer storage unit is provided to the developer storage unit, the folded developer storage unit is not opened. Therefore, when the developer storage unit is folded with the cap unit facing inward, the outside is prevented from being stained by the used developer container with a simple constitution. Further, the used developer container is folded and held with the stained cap unit facing inward, thereby preventing the stain of the developer container from spreading to depository. Further, the developer container can be retrieved by mail.

According to the second aspect of the invention, since the developer storage unit has an air-permeable unit, pressure of air to be sent to the developer storage unit can be reduced.

According to the third aspect of the invention, since the memory element is detachably attached to the cap unit, the developer storage unit can be discriminated. When a container with no developer is reattached by mistake, a user can discriminate the container from new ones. Further, the memory element can be used for management of shipment on manufacturer's side.

According to the fourth aspect of the invention, the folding indication portion for folding and the holding indication portion for indicating a holding place of the holding member are provided to the surface of the developer storage unit. Therefore, the folding of the developer storage unit and the holding of the folded developer storage unit can be facilitated.

According to the fifth aspect of the invention, the display portion on which the folding method and the holding method are described is formed on the surface of the developer storage unit, thereby further facilitating the folding. Further, the used developer container can be folded properly and the cap unit can be covered with the developer storage unit, thereby preventing the stain of the developer from contacting with the outside.

According to the sixth aspect of the invention, since the holding member is the adhesive tape or the mechanical fastener, the holding member having a simple constitution can be provided at low price. The mechanical fastener can be attached or detached many times. Further, the used developer container is folded so that the stained cap unit does not appear on the outside, and it is held by the adhesive tape or the mechanical fastener. This prevents from the stain of the cap unit from spreading to the depository and enables the used developer container to be retrieved by mail.

According to the seventh aspect of the invention, the holding member is formed into a pocket shape onto the surface of the developer storage unit by the sheet material. Therefore, the folded developer storage unit can be housed in the pocket type holding member easily. Further, the cap unit of the used developer container is inserted into the pocket type holding member, thereby preventing the stain of the developer container from leaking to the outside and spreading to the depository. Further, the used developer container can be retrieved by mail easily.

According to the eighth aspect of the invention, a developer supplying unit having the developer container with the effects of the first to the seventh aspects can be provided.

According to the ninth aspect of the invention, an image forming apparatus having the developer supplying unit with the effect of the eighth aspect can be provided.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A developer container, comprising:

a developer storage unit made of a flexible sheet material for storing developer, the developer storage unit comprising a lower end and an upper end located opposite the lower end;

a cap unit from which the developer is discharged provided adjacent the upper end; and a holding member mounted to the developer storage unit at a location to hold a folded state of the substantially empty developer storage unit when the substantially empty developer storage unit is folded such that the lower end of the substantially empty developer storage unit covers the cap unit.

2. The developer container according to claim 1, wherein the developer storage unit further includes an air-permeable unit.

3. The developer container according to claim 1, wherein a memory element is detachably attached to the cap unit.

4. The developer container according to claim 1, wherein a surface of the developer storage unit has a folding indication portion for folding and a holding indication portion indicating a holding place of the holding member.

5. The developer container according to claim 1, wherein a surface of the developer storage unit has a display portion on which a folding method and a holding method are described.

6. The developer container according to claim 1, wherein the holding member is either of an adhesive tape or a mechanical fastener.

7. The developer container according to claim 1, wherein the holding member is formed in a pocket shape on a surface of the developer storage unit with a sheet material.

8. The developer container according to claim 1, wherein the holding member is mounted to the developer storage unit adjacent the lower end.

9. The image forming apparatus according to claim 1, wherein the holding member is mounted to the developer storage unit at a location to hold the folded state of the substantially empty developer storage unit when the substantially empty developer storage unit is folded such that the lower end and side surfaces of the substantially empty developer storage unit cover the cap unit.

10. A developer supplying unit comprising:

a developer container including a developer storage unit made of a flexible sheet material for storing developer, the developer storage unit comprising a lower end and an upper end located opposite said lower end;

a cap unit from which the developer is discharged provided adjacent the upper end of the developer storage unit;

a holding member mounted to the developer storage unit at a location to hold a folded state of the substantially empty developer storage unit when the substantially empty developer storage unit is folded such that the lower portion of the substantially empty developer storage unit covers the cap unit; and a pumping unit that pumps the developer to supply the developer to a developing unit, wherein a volume of the developer container is reduced with pumping of the developer.

11. The developer supplying unit according to claim 10, wherein the developer storage unit further includes an air-permeable unit.

12. The developer supplying unit according to claim 10, wherein a memory element is detachably attached to the cap unit.

13. The developer supplying unit according to claim 10, wherein a surface of the developer storage unit has a folding indication portion for folding and a holding indication portion indicating a holding place of the holding member.

14. The developer supplying unit according to claim 10, wherein a surface of the developer storage unit has a display portion on which a folding method and a holding method are described.

15. The developer supplying unit according to claim 10, wherein the holding member is either of an adhesive tape or a mechanical fastener.

16. The developer supplying unit according to claim 10, wherein the holding member is formed in a pocket shape on a surface of the developer storage unit with a sheet material.

17. The developer supplying unit according to claim 10, wherein the holding member is mounted to the developer storage unit adjacent the lower end.

18. An image forming apparatus comprising a developer supplying unit that includes a developer container including a developer storage unit made of a flexible sheet material for storing developer, the developer storage unit comprising a lower end and an upper end located opposite said lower end;

a cap unit from which the developer is discharged provided adjacent the upper end of the developer storage unit;

a holding member mounted to the developer storage unit at a location to hold a folded state of the substantially empty developer storage unit when the substantially empty developer storage unit is folded such that the lower end of the substantially empty developer storage unit covers the cap unit; and a pumping unit that pumps the developer to supply the developer to a developing unit, wherein a volume of the developer container is reduced with pumping of the developer.

19. The image forming apparatus according to claim 18, wherein the holding member is mounted to the developer storage unit adjacent the lower end.

20. A developer container, comprising:

a developer storage unit made of a flexible sheet material for storing developer, the developer storage unit comprising a lower portion and an upper portion located opposite the lower portion;

a cap unit from which the developer is discharged provided adjacent the upper portion; and a holding member mounted to the developer storage unit at a location to hold a folded state of the substantially empty developer storage unit when the substantially empty developer storage unit is folded such that the lower portion of the substantially empty developer storage unit covers the cap unit.

21. A developer supplying unit comprising:

a developer container including a developer storage unit made of a flexible sheet material for storing developer, the developer storage unit comprising a lower portion and an upper portion located opposite said lower portion;

a cap unit from which the developer is discharged provided adjacent the upper portion of the developer storage unit;

a holding member mounted to the developer storage unit at a location to hold a folded state of the substantially empty developer storage unit when the substantially empty developer storage unit is folded such that the lower portion of the substantially empty developer storage unit covers the cap unit; and a pumping unit that pumps the developer to supply the developer to a developing unit, wherein a volume of the developer container is reduced with pumping of the developer.

22. An image forming apparatus comprising a developer supplying unit that includes a developer container including a developer storage unit made of a flexible sheet material for storing developer, the developer storage unit comprising a lower portion and an upper portion located opposite said lower portion;

a cap unit from which the developer is discharged provided adjacent the upper portion of the developer storage unit;

a holding member mounted to the developer storage unit at a location to hold a folded state of the substantially empty developer storage unit when the substantially empty developer storage unit is folded such that the lower portion of the substantially empty developer storage unit covers the cap unit; and a pumping unit that pumps the developer to supply the developer to a developing unit, wherein a volume of the developer container is reduced with pumping of the developer.

* * * * *